United States Patent [19]

Bozek

[11] 3,964,632

[45] June 22, 1976

[54] CLOSURE WITH A SLOTTED PULL TAB

[75] Inventor: John S. Bozek, Chicago, Ill.

[73] Assignee: Continental Can Company, Inc., New York, N.Y.

[22] Filed: Sept. 16, 1974

[21] Appl. No.: 506,064

[52] U.S. Cl. ..... 220/270; 220/277

[51] Int. Cl.[2] ..... B65D 41/32

[58] Field of Search ..... 220/269, 270–273, 220/277

[56] References Cited

UNITED STATES PATENTS

| | | | |
|---|---|---|---|
| 3,749,275 | 7/1973 | Smith, Jr. et al. | 220/269 |
| 3,780,902 | 12/1973 | Hole et al. | 220/270 |
| 3,795,340 | 3/1974 | Hougen et al. | 220/270 |

*Primary Examiner*—George T. Hall

*Attorney, Agent, or Firm*—John J. Kowalik; Joseph E. Kerwin; William A. Dittmann

[57] ABSTRACT

A multiple-motion easy-open closure for a can which has two rivets on the end panel, one rivet pivotably connecting a tab to the end panel and functioning to aid in cracking the score and the second rivet anchoring the tab to the end panel. The tab has a slot flanked by ribs and must be rotated until the second rivet, which extends through the slot has its head in alignment with a circular opening in the slot through which the tab may be lifted to rupture the score. The ribs are positioned tangentially to the arc of pivot of the tab and must be laterally deflected and assume an arcuate contour concentric with the pivot arc to accommodate passage of the second rivet between locked and unlocked positions.

10 Claims, 3 Drawing Figures

CLOSURE WITH A SLOTTED PULL TAB

SUMMARY OF THE INVENTION

It is well known that the accumulation of household chemicals commonly found in the home poses the threat of death or serious injury to small children. Storage of these materials in places supposedly beyond the reach of such children has not proven wholly satisfactory. Prior attempts to provide a child-resistant easy-open closure have been excessively complex and costly. It is, therefore, one of the important objects of the present invention to provide an improved safety or security closure for an easy-open container which may be readily opened by an adult but which will resist the efforts of small children to obtain access to the contents of the container.

It is a further object to provide an improved security closure that provides the adult user with visual clues as to its method of operation while retaining its child-resistant features.

It is still another object to provide an improved security closure that incorporates the concept of a tab which is anchored to the end panel when in one locked position and functions normally when in another open position.

BRIEF DESCRIPTION OF THE DRAWINGS

The various features and advantages of the security closure of this invention will be more apparent from the following detailed description when considered in connection with the accompanying drawing wherein.

DESCRIPTION OF THE PREFERRED EMBODIMENT

Figure 1:
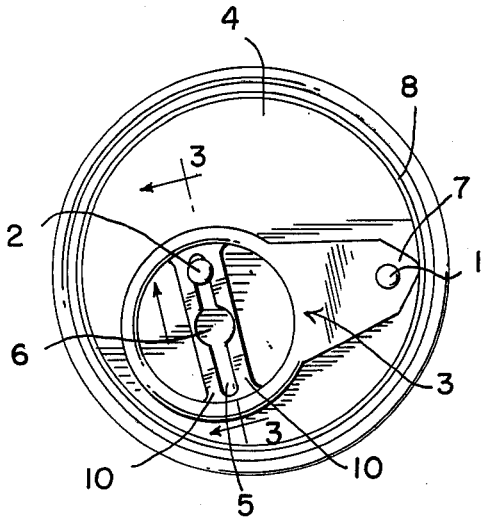
FIG. 1 is a perspective view of the upper portion of a container having in association therewith a closure device representative of the present invention, illustrating the tab in the secured position.

As shown in the drawings, the security closure of this invention for a container includes an end panel 4 with integral rivets 1 and 2, said rivets 1 and 2 being located on a diameter of said end panel 4 (although they could also be arranged on a chord) rivet 1 being located nearer the periphery of said end panel then rivet 2, a tab 3 rotatably attached to said end panel 4 by said rivet 1, a slot 5 flanked by ribs or bars 10, formed in said tab 3, said slot 5 being substantially perpendicular to the end panel diameter locating said rivets 1 and 2 and of width less than the diameter of the head of said rivet 2, said slot being enlarged at its midpoint to form a circular opening 6, having a diameter greater than the diameter of said rivet 2, a piercing or opening member 7 integrally formed on said tab 3 and a score 8 formed in said end panel 4 and therein defining an opening flap 9.

In the standard easy-open closure, which lacks said rivet 2 and said slot 5 and circular opening 6, opening is accomplished by vertically displacing the tab 3, thereby pivoting said tab 3 about said rivet 1 and imposing a downward force on said piercing member 7, said force resulting in the breaking of said end panel 4 along said score 8 beneath said piercing member 7. Continued upward displacement of said tab 3 results in controlled tearing of said end panel 4 along said score 8, the opening flap 9 defined by said score 8 being bent down and away from said end panel 4, thereby establishing an opening said end panel 4. Opening a container in this manner is well within the capability of a small child.

Figure 2:
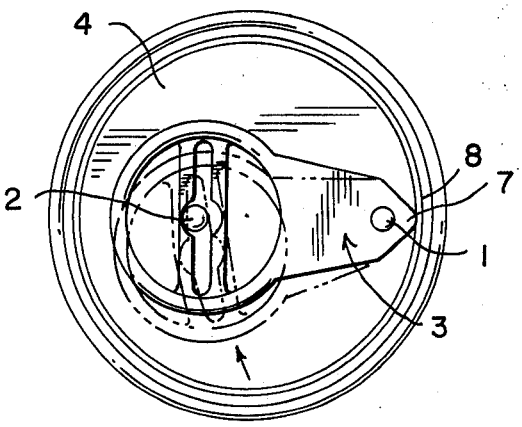
FIG. 2 is a view similar to FIG. 1 wherein the tab has been rotated to the unsecured position.
Figure 3:
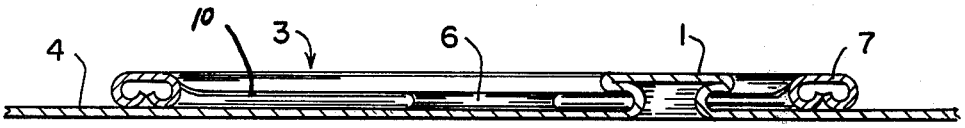
FIG. 3 is a fragmentary sectional view taken generally along line 3—3 of FIG. 1.

In the security closure of the present invention, a securing rivet 2 prevents the lifting of the tab 3. To open the safety closure, the tab 3 must first be rotated to align said securing rivet 2 with the circular opening 6 in said tab 3 (FIG. 2). Rotation of said tab 3 from the closed or secured position shown in FIG. 1 to the released or opening position shown in FIG. 2 is restrained by the parallel ribs 10 which form biasing means and must be deflected laterally to temporarily assume an arcuate contour concentric with the pivot arc of said tab 3 about said rivet 1. Rotation of said tab 3 requires a positive effort to effect the necessary deflection of said bars 10. When said tab 3 reaches the unsecured position, with said rivet 2 in said opening 6, the deflecting force on said ribs 10 is removed and said ribs 10 return to their original linear configuration, thereby providing a locking action securing said tab 3 in the unsecured position. Once said tab 3 is in the unsecured position, the closure is opened in the conventional manner as described hereinabove.

Although the presence of said securing rivet 2 and said slot 5 with circular opening 6 provide the adult user with a visual clue as to the method of operation of the security closure, their import is beyond the comprehension of a small child.

I claim:

1. An improved safety closure for use on a can or similar container comprising an end panel having an opening flap therein, a tab movably attached to said end panel for movement in a plane generally parallel to said end panel from a non-opening position to an opening position and having means for opening said flap, said tab in the opening position being operative to open said flap, and means for restraining said tab from movement to said opening position from said non-opening position, said restraining means comprising interengaging means on said end panel and on said tab and formed and arranged to hold said tab against said end panel for the entire extent of movement from said non-opening position to said opening position, one of said restraining means being distortable consequent to said movement of said tab from said non-opening position to said opening position preventing disengagement of said interengaging means until said tab is disposed in said opening position.

2. An improved safety closure for use on a can or similar container comprising an end panel having two integral rivets and a score defining an opening flap, a tab pivotably attached by one of said rivets to said end panel and having means for breaking said score, and said tab having means defining a slot, said slot flanked by means engaging the other of said rivets thereby restraining said tab from vertical and pivotal displacement, said slot-defining means shaped to form an enlarged passage alignable with said other rivet to accommodate passage of said other rivet therethrough to release said tab and thereby permit said tab being lifted to break said score.

3. An improved safety closure for use on a can or similar container comprising an end panel having an opening flap therein, a tab movably attached to said end panel for movement in a plane generally parallel to said end panel and having means for opening said flap and having an opening position whereat said means on said tab is operative to open said flap, and means for restraining said tab from movement to the opening position from an initial non-opening position, said restraining means comprising interengaging means on said end panel and on said tab, one of said restraining means being distortable consequent to said movement of said tab to disengage said interengaging means consequent to disposing said tab in said opening position, said restraining means commprising an attachment element securing said tab to said end panel, said attachment element comprising a post member secured to said end panel and a flange element on the free end of said member, said element overhanging a portion of said tab when said tab is out of said opening position, said restraining means comprising rib means formed in said tab, and said flange element engaging said rib means.

4. An improved safety closure as defined in claim 3, wherein said rib means comprises two substantially parallel rib members defining a slot therebetween, and said attachment element engages at least one of said rib members.

5. An improved safety closure as defined in claim 4 wherein said slot is of width less than the said flange element.

6. An improved safety closure as defined in claim 5, wherein said rib means has a cutout area forming an opening sufficient to allow passage of said flange element.

7. An improved safety closure as defined in claim 6 wherein said attachment element is formed integrally with said end panel.

8. An improved safety closure as defined in claim 7 wherein said rib members are deflected laterally to temporarily assume an arcuate contour concentric with the pivot arc of said tab upon rotation of said tab.

9. An improved safety closure as defined in claim 8 wherein said rib members provide a positive locking action when said tab is positioned with said rivet in said opening.

10. An improved safety closure for use on a can or similar container comprising an end panel having an opening flap therein, a tab movably attached to said end panel and having means for opening said flap and having an opening position whereat said tab is liftable away from said panel and said means on said tab is operative to open said flap, and means for restraining said tab from movement to the opening position from an initial non-opening position whereat said tab is not liftable away from said end panel, said restraining means being deformable consequent to displacement of said tab parallel to the plane of the end panel from said non-opening position to said opening position.

* * * * *